US005401314A

United States Patent [19]

Kustermann

[11] Patent Number: 5,401,314

[45] Date of Patent: Mar. 28, 1995

[54] DEVICE FOR COATING TRAVELING WEBS OF PAPER OR BOARD ON BOTH SIDES USING TWO WEB GUIDE ROLLS

[75] Inventor: Martin Kustermann, Heidenheim, Germany

[73] Assignee: J.M. Voith GmbH, Heidenheim, Germany

[21] Appl. No.: 42,544

[22] Filed: Apr. 5, 1993

[30] Foreign Application Priority Data

Apr. 4, 1992 [DE] Germany ..... 42 11 401.2

[51] Int. Cl.[6] ..... B05C 1/12

[52] U.S. Cl. ..... 118/206; 118/217; 118/227; 118/258

[58] Field of Search ..... 118/206, 217, 227, 216, 118/223, 228, 246, 261, 262, 258, 411, 412

[56] References Cited

U.S. PATENT DOCUMENTS 4,259,921 4/1981 Wallsten ..... 118/206
5,203,920 4/1993 Plomer ..... 118/227

*Primary Examiner*—W. Gary Jones
*Assistant Examiner*—Dean T. Nguyen
*Attorney, Agent, or Firm*—Ostrolenk, Faber, Gerb & Soffen

[57] ABSTRACT

The present invention relates to a device for coating traveling webs of paper or board having two web guide rolls closely adjacent each other. Each roll has an applicator associated on its periphery. The applicators cooperate with each other at least in part for the coating of the web directly one after the other, preferably within at most 0.15 seconds. The rolls are arranged one above the other—possibly somewhat laterally shifted from each other. The lower roll has an applicator chamber of a nozzle applicator in the region of its periphery remote from the upper roll. The upper roll has at least one of the following on its web-entrance side—with respect to the lower roll—a sump chamber for coating composition formed of a doctor element and its mount and on its other side, an applicator chamber of a nozzle applicator. The lower roll may be adapted to be swung or lowered away from the upper roll and/or the upper roll may be liftable away from the lower roll.

36 Claims, 2 Drawing Sheets

FIG. 3
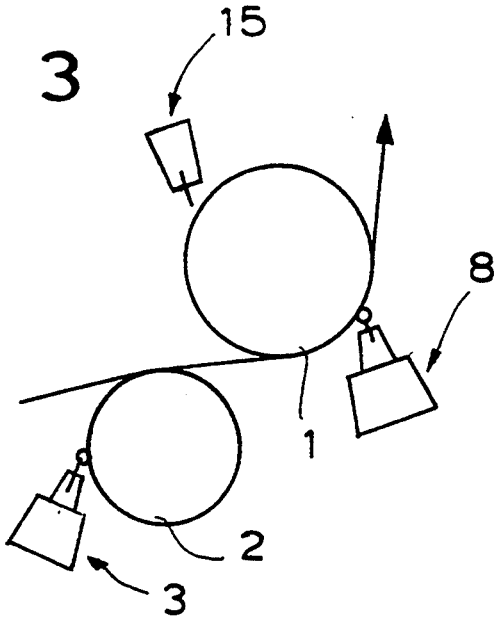
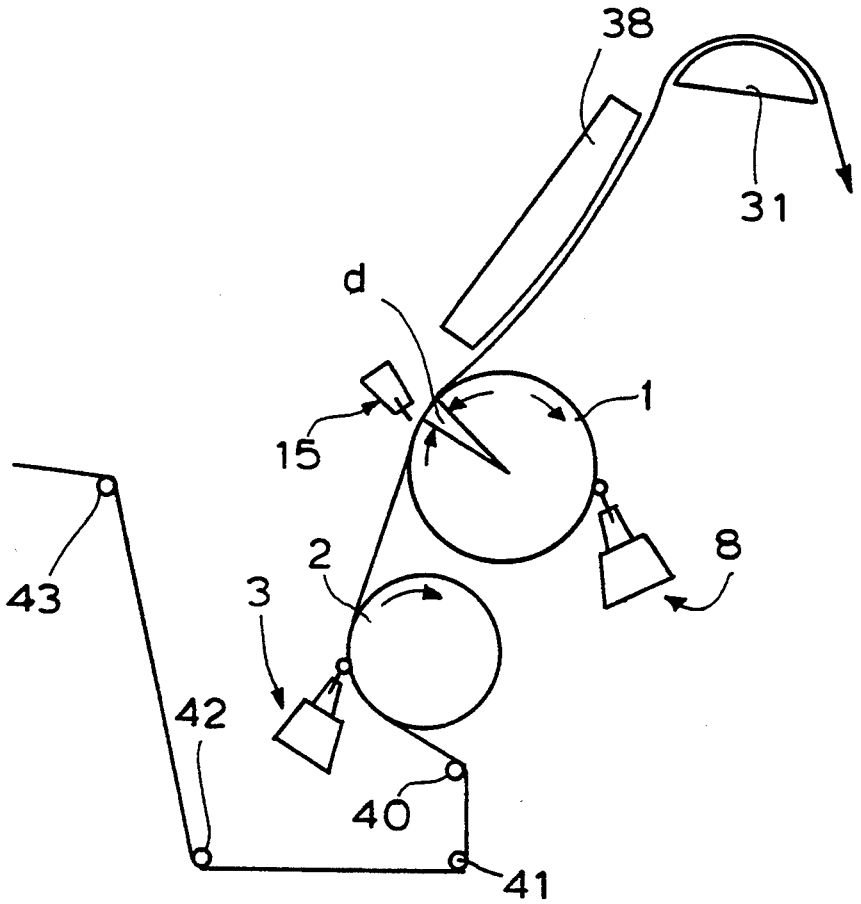
FIG. 4

DEVICE FOR COATING TRAVELING WEBS OF PAPER OR BOARD ON BOTH SIDES USING TWO WEB GUIDE ROLLS

BACKGROUND OF THE INVENTION

The present invention relates to a coating device for coating a moving web of paper or board.

A device known from Federal Republic of Germany 41 14 647 A1 includes a small diameter roll arranged below a larger diameter roll, a nozzle applicator associated with the lower roll on one side with reference to the vertical and an applicator, with a sump formed by a doctor element and its mount, being arranged on the other side with reference to the vertical. On the first side with reference to the vertical of the upper roll there is also an applicator having a sump which is formed by a doctor element and its mount. With this device, various coating processes can be carried out. But, a very different path of the web is necessary in each case. Thus, for one case of coating, the web is fed to a press nip formed between the two rolls from the cellar and is fed from a different side of the lower roll than for the other case of coating. In order to achieve this, there is further provided, in the region of the upper roll or its applicator, an operator's platform for the applicator of the upper roll, which platform can at least partially be swung away. A swingable mount for a deflection roll is also provided in that region. Nevertheless the possibility of variation for the necessary cases of coating is still not satisfactory. By a displaceable mounting of either of the lower or upper rolls, the two can form a press nip with respect to each other or this press nip can be eliminated. However, the ropeway for the threading of the web is very complicated.

SUMMARY OF THE INVENTION

The object of the invention is to create great variability in the coating possibilities in the case of a coating device which uses two rolls, with little additional expense and a relatively simple ropeway. In this connection, single-side or double-side coating are optionally possible with or without strong application pressure, i.e. pressure of the rolls on the coated web.

This object is achieved in accordance with the invention. The invention concerns a device for coating a traveling web of paper or board. There are an upper and a lower web guide roll having respective peripheries. The rolls are placed so that one roll coats the web directly after the other roll.

There is a respective coating applicator at the upper roll periphery and at the lower periphery. The lower roll applicator is located in the region around the lower roll that is remote from the upper roll. The upper and lower rolls are movable away from and toward each other. Preferably, the upper roll applicator is disposed around the upper roll periphery at a side thereof toward which the web moves toward the upper roll. There may be another upper roll applicator disposed around the upper roll periphery at the side past which the web leaves the other roll or there may be only the other one of these applicators. The lower roll is placed below and rearward in the path of the web from the upper roll and when the upper roll is in contact with the lower roll, the lower roll is in contact with the upper roll at an arcuate angle spaced back from the lowest point on the upper roll. Substantially the same web path can possibly be present, in advantageous manner, in all cases. With the invention, in the case of a coating which is intended for papers of not very high quality, the rolls and applicators are so used that the shell surface of the roll in question is coated first in its region which is not wrapped by the web, and only then is the coating transferred to the web. In this connection the lower roll is preferably brought close to the upper roll, leaving a relatively narrow coating gap, or the lower is pressed against the upper roll in the case of sizing.

A great additional advantage over Federal Republic of Germany 40 14 647 A1 is the fact that in the present invention, the lower side of the web is coated. This is not the case in the German patent.

BRIEF DESCRIPTION OF THE DRAWINGS

The invention will be described below with reference to the diagrammatic drawings. Each of FIGS. 1, 2, 3 and 4 shows a different web path, possibly together with a different position of the lower and/or upper roll and all of the same coating device shown in FIG. 1.

DESCRIPTION OF THE PREFERRED EMBODIMENTS

Figure 1:
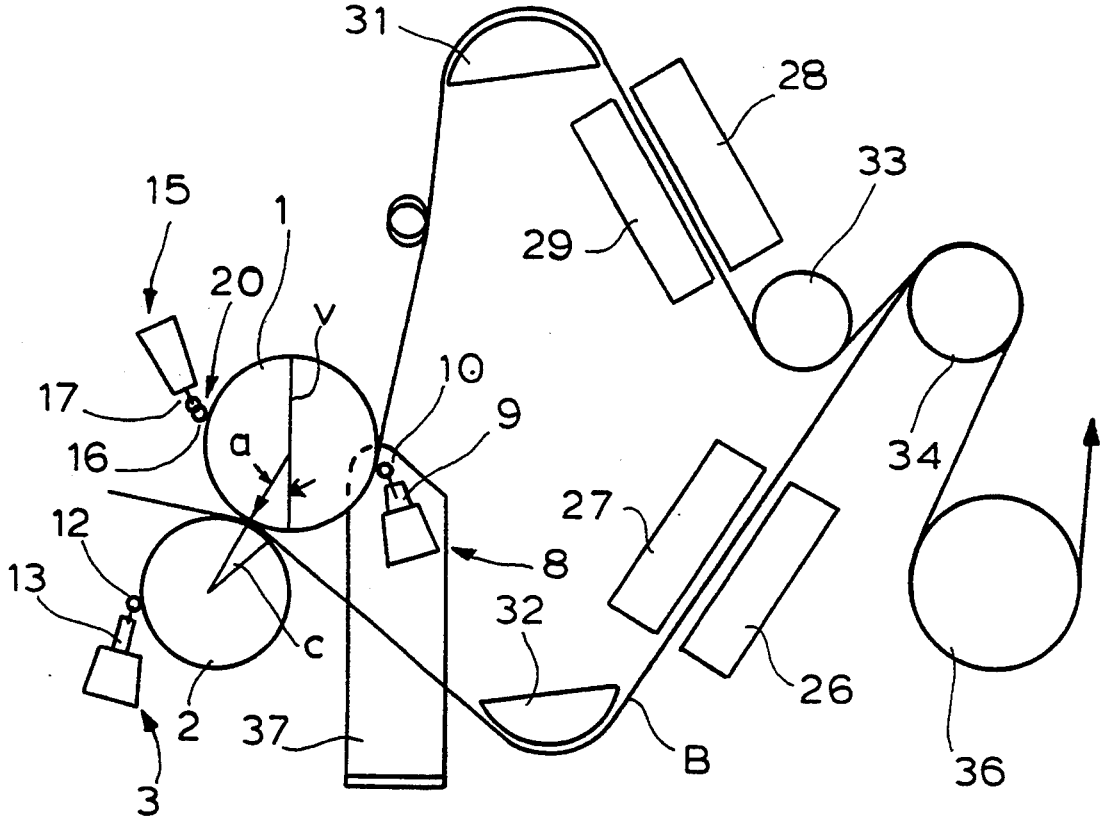

In FIG. 1, rolls 1 and 2 are arranged essentially one above the other. The lower roll 2 is arranged somewhat laterally offset with respect to the upper roll 1 and the web B in the direction opposite the direction of travel of the web (see arrow). The lower roll 2 is supported to be either swung away or lowered away from the upper roll, enabling the roll positions shown in FIGS. 1–3. Alternately, the upper roll is supported to be lifted away from the lower roll for the same roll position adjustments. In FIG. 1, the lower roll 2 is laterally shifted opposite the web travel direction with respect to the lowest point of the upper roll so that with the lower roll against the upper roll, the point of contact between the two rolls is at a distance of a circumferential angle of the upper roll of between 10° and 70°, and preferably between 15° and 40°, from the lowest point of the upper roll. In the circumferential region of the roll 2 which is not wrapped by the web and which precedes entry of the web into the nip between the rolls, the coating composition is applied by a nozzle applicator 3 to the shell of the lower roll 2. The applicator has an application chamber 13 remote from the upper roll 1 and a doctor element 12, here shown as a roller doctor. The doctor element could also be a coating blade. The roller doctor or bar could have a grooving in its circumferential direction, for instance, developed as a wire wrapping. The same construction is used for the applicator 8 of the upper roll, which is arranged with respect to the vertical line V on the other side from the applicator 3 of the lower roll that is past the nip between the rolls 1 and 2. The applicator 8 also has an application chamber 9 and a doctor element 10. On the one side with respect to the vertical V, that is the side prior to the nip between the rolls, there is preferably only optionally provided an applicator 15 associated with the upper roll 1. Either or both of the applicators is provided. A sump 20 with preferably free liquid level for coating composition is formed by means of a doctor element 16 and its support 17. This sump can be formed both of coating composition of low pigment content (solids content as a rule less than 45%) and of size, possibly also strongly diluted with water, or else water.

In its path, after the web leaves the applicators, the web is fed obliquely downward to a contact-less air-jet web deflection device 32. The device 32 deflects the web by an angle of less than 120° (here about 92°) back in the upward direction.

In each case one of the upper applicators can be used in combination with the applicator of the lower roll for applying coating to both sides of the web. The nozzle applicator 3 of the lower roll 2 can in this connection also apply size again or else a coating composition containing pigment. If the "sump" applicator 15 of the upper roll is used, the other applicator 8 of the roll can be used for cleaning the roll 1 by means of a scraper blade or of a smooth doctor bar.

In the event that the size material is applied on both sides of the web, a high pressing pressure is employed in the press nip between the two rolls 1 and 2, as has been traditionally known in the case of size presses.

Figure 2:
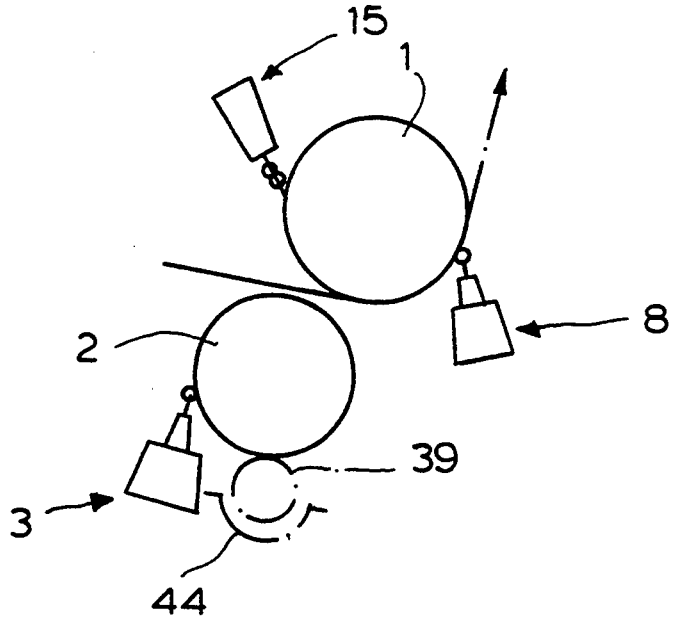

In FIG. 2, the lower roll 2 is spaced from the upper roll 1 and the web passes around only the upper roll 1. This produces a different path of the web which is used primarily in order to coat the lower side of the web with the applicator 8. The coating composition has a pigment content of between 30 and 70% and an application being effected of at least 5 g/m$^2$, and in most factories at least 10 g/m$^2$. The other side of the web can be slightly pigmented with the "sump" applicator 15 or else can be sized with extensive dilution by water in order to improve the flatness of the web. On the other side, a scraper blade or a smooth doctor bar can also be used here in order to clean the roll 1. In the case of two-sided coating, there is the advantage that only the shell of a roll transfers the composition to the web, i.e. transfers it to it.

The different path of the web for the roll arrangement in FIG. 2 is then along the upper elements of the device shown in dash-dot line in FIG. 1. In this path, after leaving the upper roll 1, the web is fed also to a contact-less air-jet web deflection device 31 which preferably deflects the web by an angle of more than 125° (in this case about 133°; see FIG. 1). This path of the web can also be the only one in all cases, particularly if the "coating mechanism" 9 is arranged far towards the bottom on roll 1 and roll 2 is so arranged with respect to roll 1 that the angle a is present on the other side of the vertical V or is very small.

The web path in FIG. 3 permits predosing of the roll 2 with the applicator 3 and afterdosing or else a pure smoothing, for instance of the upper roll 1 by the coating blade of the nozzle applicator 8. Here control over the predosing quantity at the lower roll is possible by the web tension established. The same can also be effected with respect to the upper roll and in such case by the applicator 15. In principle, the applicators can have coating blades or roll doctors, provided with either a smooth or fluted surface.

The following hardnesses for the covers of the rolls are preferably provided. Lower roll 2 has a cover hardness of between 0 and 20 P and J, while upper roll 1 has a cover hardness of between 20 and 70 P and J (according to Pucey and Jones). In principle, a hardness of between 0 and 90 P and J is possible.

The lower roll should be so arranged that, upon contact or the formation of an application slot with respect to the upper roll, its place of contact or the application slot is at a circumferential angle a of between 10° and 70° and preferably 15° to 40° from the lowest point of the upper roll. This has the advantage that the angles of wrap of the rolls 2 and 1 by the web angle a (FIG. 1) and angle d (FIG. 4) are rather small. The air deflection device 32 and the heating device require a large amount of space. Yet the invention nevertheless provides sufficient space for the deflection rolls 40 and 41 (FIG. 4) and there is also still space for the stands 37 of the applicator 8 (FIG. 1).

With the present web speeds which are customary today, coating of the web at the 2 or 3 applicators, which are arranged behind each other, is effected at most within 0.15 sec.

The roll 2 is preferably developed with controlled sag compensation, as described, for instance, in German patent publications DE 30 11 669, DE 29 38 427, DE 29 42 002 or DE 31 01 115. Both rolls can also preferably be developed in such a manner that their temperatures can be controlled.

FIG. 1 also indicates the path of the web which corresponds to the roll configuration of FIG. 2. From this it can be seen that, after deflection rolls 33 and 34, the course of the web is advantageously over cylinder 36 and thereafter in all cases is the same. The heating devices 26, 27, 28, 29 for the drying of the web can be of any development. Roller 34 can also be a small drying cylinder, a so-called baby cylinder.

FIG. 2 shows a dip roll 31, in dot-dash line, which dips into a trough 44. Instead of using the applicator 3, the dip roll 31 applies the coating composition to the shell of the roll.

FIG. 4 shows a solution for extreme demands. With this solution, the top side of the web can be coated with the same unit. For this purpose the direction of rotation of the roll 1 must be reversed. It acts now as guide roll. The optimal dryer 38 can, in the event of straight guidance of the web, be a radiation dryer (for instance IR el/gas) or a combination dryer (IR+air). This dryer is preferably developed with a slight curvature to serve as a "pseudo" air deflection device so that the entrance conditions of the contact-less web path at 31 remain unchanged, as compared with FIG. 2, that is the same conditions in FIGS. 2, 3 and 4. The path of the web is modified by deflection rolls 40–43 in FIG. 4.

Nozzle applicators of generally customary construction are known from U.S. Pat. No. 4,250,211. Sump applicators—with free liquid level—are known from German patent DE 39 22 535 or U.S. Pat. No. 2,970,564, the former also showing a roller doctor with thread-like "circumferential grooves" (see in this connection also U.S. Pat. No. 3,387,585). The lower roll is preferably developed as a sag-compensated roll—particularly in the case of dip-roll application (roll 39, FIG. 2), but also in other cases. Both rolls 1 and 2 should be capable of being cooled and heated for the best results of the coating.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for coating a traveling web of paper of board, comprising:

an upper web guide roll having a first periphery; a lower web guide roll located below the upper web guide roll and having a respective second periphery;

the rolls being placed so that one roll coats the web directly after the other roll coats the web; the upper and the lower rolls being movable away from and toward each other; the rolls being laterally shifted with respect to each other;

an upper coating applicator at the upper roll periphery; a lower coating applicator at the lower roll periphery; the lower applicator being in the region around the lower roll that is remote from the upper roll.

2. The device of claim 1, wherein the upper applicator is disposed around the upper roll periphery at the side of the upper roll toward which the web is moving when approaching said coating device or said roll.

3. The device of claim 2, wherein the upper applicator further comprises a second upper applicator disposed around the upper roll periphery at the side of the upper roll away from which the web leaves the upper roll.

4. The device of claim 2, wherein the upper applicator comprises a sump chamber for coating composition and includes a doctor supported for doctoring coating on the upper roll periphery.

5. The device of claim 1, wherein the upper applicator is disposed around the upper periphery at the side of the upper roll away from which the web leaves the upper roll.

6. The device of claim 5, wherein the upper applicator comprises a nozzle applicator having a nozzle for supplying coating to the upper roll.

7. The device of claim 1, wherein the lower roll is movable away from the upper roll.

8. The device of claim 1, wherein the upper roll is movable away from the lower roll.

9. The device of claim 1, further comprising means directing the web to pass between and to contact both the upper and lower roll peripheries.

10. The device of claim 1, wherein the rolls are so placed and spaced that the rolls successively apply coating at a time interval within 0.15 seconds.

11. The device of claim 1, wherein the upper roll periphery has a hardness of between 20 and 70 P&J, and the lower roll periphery has a hardness of between 0 and 20 P&J.

12. The device of claim 1, wherein the lower applicator comprises a dip roll for being dipped into a coating composition and for rolling it on the lower roll.

13. The device of claim 1, further comprising a contact-less air-jet web deflection device positioned after the upper and lower rolls in the travel direction of the web, the deflection device being positioned and shaped for deflecting the path of the web from obliquely downward to obliquely upward.

14. The device of claim 13, further comprising heating means positioned along the pathway of the web following the deflection device.

15. The device of claim 13, wherein the deflecting device is shaped for deflecting the web by an angle of less than 130°.

16. The device of claim 15, wherein said angle is less than 120°.

17. The device of claim 13, further comprising a second, contact-less air-jet web deflecting device also positioned along the path of the web following the upper and lower rolls and the path following the rolls such that when the rolls are moved apart, the deflection device is arranged above the center axis of the upper roll and is shaped and positioned for deflecting the direction of travel of the web from obliquely upward to obliquely downward.

18. The device of claim 1, further comprising a contact-less air-jet web deflection device arranged along the web path following the upper and lower rolls such that when the rolls are moved apart, the deflection device is arranged above the center axis of the upper roll and is shaped and positioned for deflecting the direction of travel of the web from obliquely upward to obliquely downward.

19. The device of claim 18, further comprising heating means positioned along the pathway of the web following the deflection device.

20. The device of claim 18, wherein the deflecting device is shaped for deflecting the web by an angle of more than 125°.

21. The device of claim 20, wherein said angle is more than 130°.

22. The device of claim 1, wherein the lower roll has a diameter that is at least 20% smaller than the diameter of the upper roll.

23. The device of claim 1, wherein the web is guided to only contact part way around the periphery of the upper and lower rolls;

the lower applicator is positioned to apply coating only to the region of the periphery of the lower roll which is not wrapped by the web.

24. The device of claim 23, wherein the lower applicator is adapted to apply a coating composition at a dry weight in an amount of at least 5 $g/m^2$.

25. The device of claim 24, wherein said amount is more than 9 $g/m^2$.

26. The device of claim 1, wherein where the lower roll is away from the upper roll, the upper applicator is positioned to apply coating directly to the bottom side of the web away from the upper roll.

27. The device of claim 26, wherein the upper applicator applies coating composition at a dry weight of at least 5 $g/m^2$.

28. The device of claim 27, wherein said amount is at least 10 $g/m^2$.

29. The other device of claim 1, wherein when the upper and lower rolls are in contact, the upper applicator is positioned to apply a coating composition directly to the part of the periphery of the upper roll not wrapped by the web, and the upper and lower rolls being positioned to define a coating transfer slot between them.

30. The device of claim 1, wherein the upper applicator comprises a sump chamber for coating composition and the upper applicator is positioned for applying coating composition directly to the arcuate region of the upper roll which is not wrapped by the web.

31. A device for coating a traveling web of paper or board, comprising:

an upper web guide roll having a first periphery; a lower web guide roll located below the upper web guide roll and having a respective second periphery;

the rolls being placed so that one roll coats the web directly after the other roll coats the web; the upper and the lower rolls being movable away from and toward each other;

an upper coating applicator at the upper roll periphery; a lower coating applicator at the lower roll periphery; the lower applicator being in the region around the lower roll that is remote from the upper roll;

wherein the rolls are laterally shifted with respect to each other-along the path of the traveling web.

32. The device of claim 31, wherein the rolls are so placed and spaced that the rolls successively apply coating at a time interval within 0.15 seconds.

33. A device for coating a traveling web of paper or board, comprising:

an upper web guide roll having a first periphery; a lower web guide roll located below the upper web guide roll and having a respective second periphery;

the rolls being placed so that one roll coats the web directly after the other roll coats the web; the upper and the lower rolls being movable away from and toward each other;

an upper coating applicator at the upper roll periphery; a lower coating applicator at the lower roll periphery; the lower applicator being in the region around the lower roll that is remote from the upper roll;

wherein the lower roll is laterally shifted opposite the web travel direction with respect to the lowest point around the upper roll.

34. The device of claim 33, wherein the upper and lower rolls are placed against each other, the point of contact between the rolls is at a circumferential angle around the upper roll of between 10° and 70° from the lowest point of the upper roll.

35. The device of claim 33, wherein the upper and lower rolls are placed against each other, the point of contact between the rolls is at a circumferential angle around the upper roll of between 15° and 40° from the lowest point of the upper roll.

36. The device of claim 33, wherein the rolls are so placed and spaced that the rolls successively apply coating at a time interval within 0.15 seconds.

* * * * *